United States Patent [19]

Hendrickson et al.

[11] 4,060,136

[45] Nov. 29, 1977

[54] MOTOR GRADER BLADE MOUNTING AND TILT MECHANISM

[75] Inventors: Vergil Philip Hendrickson, Morton; Carroll Richard Cole, Decatur, both of Ill.

[73] Assignee: Caterpillar Tractor Co., Peoria, Ill.

[21] Appl. No.: 696,106

[22] Filed: June 14, 1976

[51] Int. Cl.[2] ..... E02F 3/76

[52] U.S. Cl. ..... 172/795; 92/118

[58] Field of Search ..... 172/767, 789, 791, 792, 172/793, 794, 795, 796, 797, 801, 802, 803, 804, 805, 806, 807, 808, 809; 214/768; 92/118

[56] References Cited

U.S. PATENT DOCUMENTS

| | | | |
|---|---|---|---|
| 1,986,173 | 1/1935 | Wold | 172/793 |
| 2,147,631 | 2/1939 | Arndt | 172/793 |
| 2,600,244 | 6/1952 | Harper | 172/805 |
| 2,950,550 | 8/1960 | French | 172/804 |
| 2,983,059 | 5/1961 | Skromme | 172/809 |
| 3,147,671 | 9/1964 | Geyer | 91/422 |
| 3,311,026 | 3/1967 | Crisp | 91/401 |
| 3,444,936 | 5/1969 | Page et al. | 172/795 |
| 3,521,782 | 7/1970 | Peterson et al. | 214/768 |
| 3,631,930 | 1/1972 | Peterson | 172/804 |
| 3,683,754 | 8/1972 | Stuyvenberg | 92/165 R |

*Primary Examiner*—Richard T. Stouffer

*Attorney, Agent, or Firm*—Wegner, Stellman, McCord, Wiles & Wood

[57] ABSTRACT

A motor grader has a circle with integral, depending arms at the rear, and the lower ends of the arms extend forwardly so that blade mountings, comprising bearing housings pivoted at their lower ends to the extremities of the arms, extend upwardly in very close proximity to the fronts of the arms. Two hydraulic cylinder and piston units for tilting the blade mountings are carried in sleeves which are integral with and between the arms, directly behind the upper end portions of the blade mountings, which permits the use of very short stroke pistons that are well protected from damage by earth and rocks piled up by the blade. In addition the units are mounted in spherical bearing and socket means for limited universal movement within the sleeves. Further, the piston rods extend along shallow chords of a circle struck about the pivots which mount the bearing housings, so working forces are applied substantially axially to the piston rods in all positions of the bearing housings.

5 Claims, 3 Drawing Figures

Fig-1-
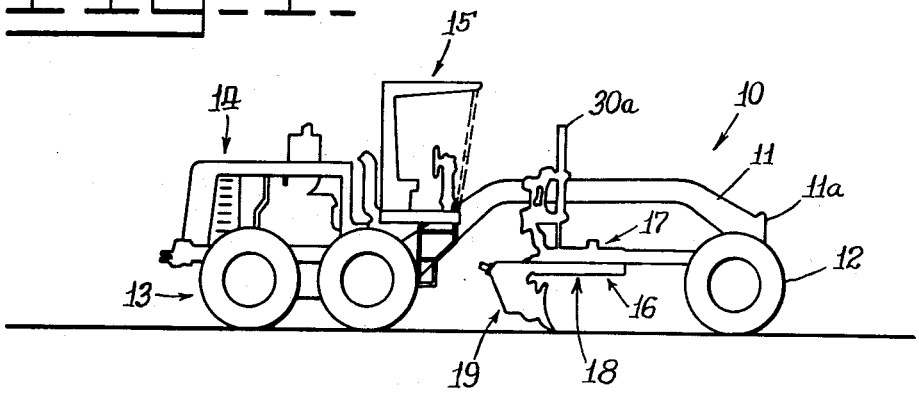
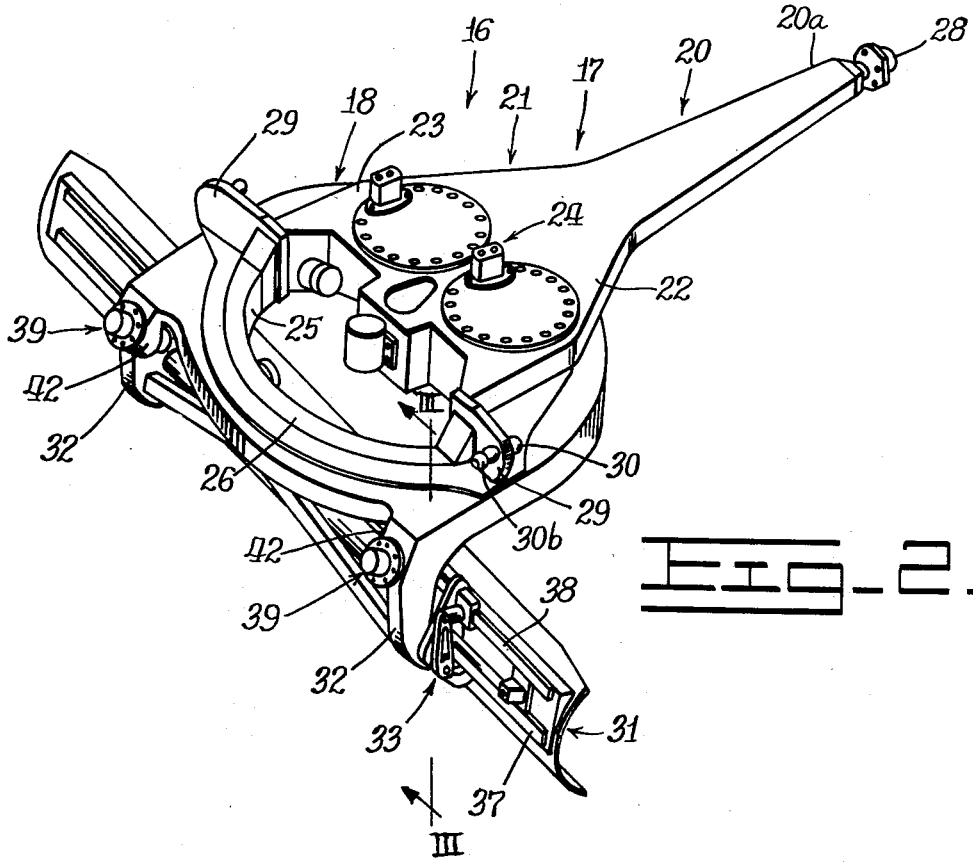
Fig-2-

MOTOR GRADER BLADE MOUNTING AND TILT MECHANISM

CROSS REFERENCE TO RELATED APPLICATIONS

Details of the draw bar structure and of the circle mounting bar and circle assembly which are illustrated and described generally in this application are described in detail and claimed in copending U.S. patent applications of Carroll Richard Cole, Ser. No. 661,880 filed Feb. 27, 1976 and Ser. No. 663,594, filed Mar. 3, 1976 now U.S. Pat. No. 4,015,669, issued Apr. 5, 1977.

The blade structure which is illustrated and described generally in this application is described in detail and claimed in copending U.S. patent application of Carroll Richard Cole Ser. No. 696,161, filed June 14, 1976.

The blade mounting which is illustrated and described generally in this application is described in detail and claimed in copending U.S. patent application of Carroll Richard Cole, Ser. No. 696,163, filed June 14, 1976.

The universal mounting of the tilt cylinders which is illustrated and described generally in this application is described in detail and claimed in copending U.S. patent application of Richard Allan Atherton and Carroll Richard Cole, Ser. No. 696,105, filed June 14, 1976.

BACKGROUND OF THE INVENTION

Motor graders have a longitudinal main frame which has a dirigible wheel assembly at its forward end, an operator's cab at its rearward end portion, and a traction chassis for the motor and power train behind the cab. The motor grader blade is suspended from the main frame by means of a circle draw bar and a circle. The circle draw bar has its front end connected to the front of the main frame by a ball and socket connection, while the rearward portion of the circle draw bar is suspended from the main frame by hydraulic cylinder and piston means which permit the draw bar to swing in a vertical plane about its front end.

The circle is mounted on the rearward portion of the circle draw bar for rotation about a vertical axis, and there is a driving interconnection between a motor on the circle draw bar and a ring gear on the circle to effect such rotary motion of the circle.

The grader blade is mounted upon the circle so that rotation of the circle changes the angle of the blade with reference to the path of travel of the grader, while swinging the circle draw bar in a vertical plane about its forward end changes the vertical position of the grader blade with reference to the ground.

In addition, the grader blade is mounted on a horizontal axis so that it may be tipped with respect to the circle by hydraulic cylinder and piston means to change the angle of attack of the blade and it may also be shifted endwise in its mounting.

The hydraulic cylinder and piston units which have heretofore been used to control the tilt of the grader blade assembly have been subject to damage from masses of earth and rocks pushed up by the grader blade moldboard. In addition, the necessity for connecting the cylinder of a hydraulic cylinder and piston unit to the circle with the rod connected to the blade carrying means requires that the head end of the cylinder be mounted to pivot about a transverse axis, and elimination of excessively close manufacturing tolerances for such heavy equipment make it highly desirable that the head end of the cylinder be rotatable about an upright axis as well. However, double trunnion mountings are quite large and clumsy, and cannot be adequately protected against damage from dirt and dust in the very difficult environment in which such hydraulic cylinder units are used.

In addition, the mounting of the tilt cylinder units on previously available motor graders has put them in such a position that very long and relatively expensive units have been required.

Typical mountings of hydraulic cylinder and piston units in heavy earth moving equipment are disclosed in U.S. Pat. Nos. 3,311,026, 3,521,782, and 3,631,930. Also of interest are U.S. Pat. Nos. 3,147,671 and 3,683,754.

SUMMARY OF THE INVENTION

The principal object of the present invention is to provide an improved arrangement of the blade support arms on a motor grader circle, the blade carrying means which is pivoted on the arms, and hydraulic cylinder and piston units for tilting the blade carrying means about their pivots.

The principal object is achieved by the following novel structure.

1. The support arms have lower ends which extend forwardly, and blade carrying means has its lower part mounted on the forward extremities of the arms and extending upwardly in very close proximity to the fronts of the arms so that cylinder and piston units which control the tilt of the blade carrying means may have their cylinders supported upon the arms and their piston rods connected to upper portions of the blade carrying means which permits the use of extremely compact, short stroke cylinder and piston units.

2. The blade carrying means has portions extending laterally inwardly with respect to the arms, and sleeves are formed integrally with the arms in alignment with said portions of the blade carrying means so that the cylinder and piston units may be mounted in the sleeves where they are well protected from damage by dirt and rocks which may pile over the top of the blade assembly moldboard.

3. The cylinders of the units are mounted in the sleeves in spherical bearing and socket means which afford limited universal movement, which affords a very compact mounting that eliminates any need for close tolerances between the arms and the blade carrying means.

THE DRAWINGS

FIG. 1 is a side elevational view of a motor grader embodying the invention;

FIG. 2 is a perspective view of a subassembly consisting of a circle mounting bar, a circle, and a grader blade assembly and improved grader blade support and tilt control means which embodies the present invention; and FIG. 3 is a fragmentary sectional view on an enlarged scale taken substantially as indicated along the line III—III of FIG. 2 with parts of the circle structure omitted for clarity.

DETAILED DESCRIPTION OF THE INVENTION

Figure 3:
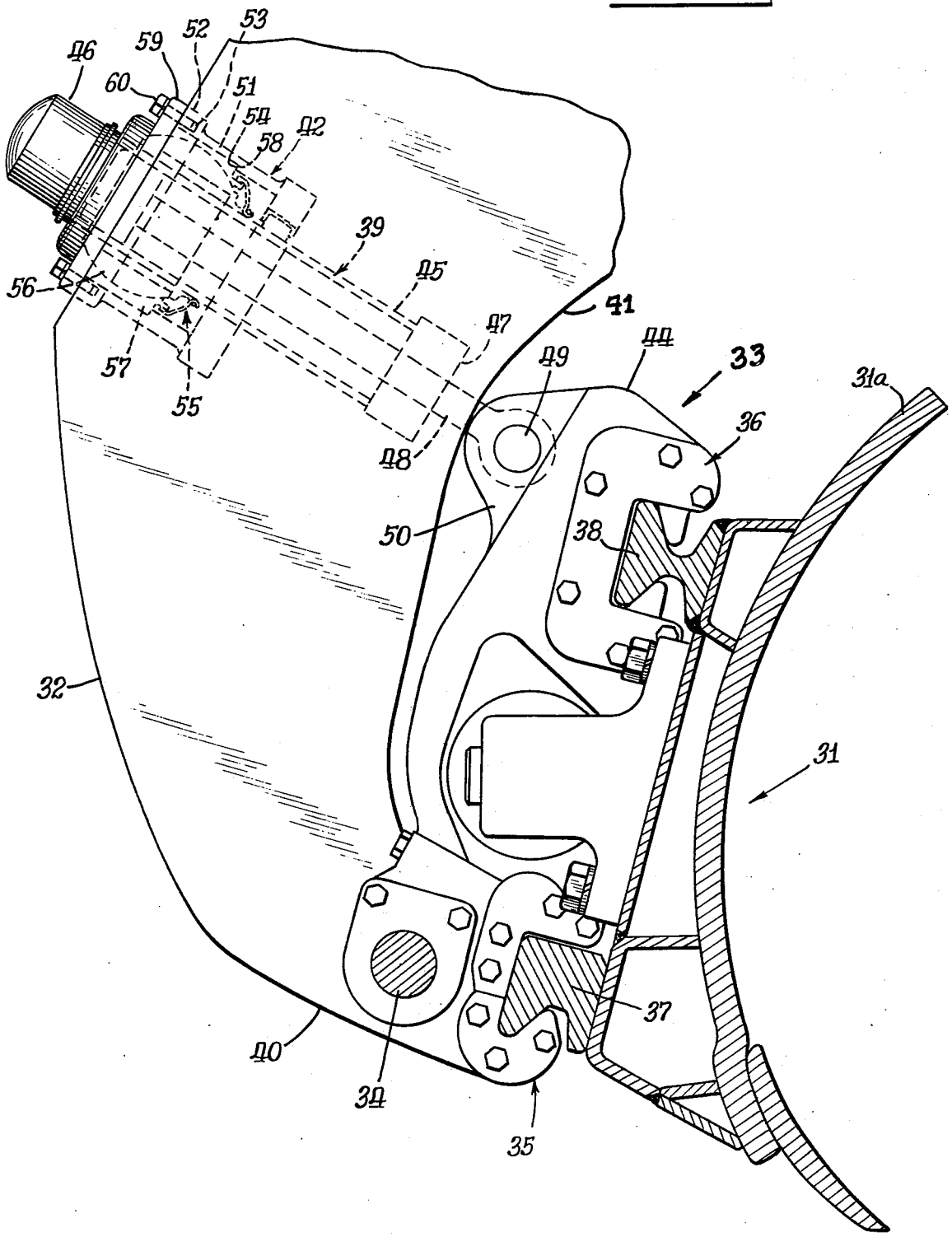

Referring first to FIG. 1 of the drawings, a motor grader, indicated generally at 10, includes a longitudinal main frame 11 the front end **11*a* of which is supported upon a dirigible front wheel assembly 12, and the rear end of which constitutes part of a traction chassis, indicated generally at 13, on which is mounted a power plant, indicated generally at 14. An operator's cab, indicated generally at 15, is on the rear portion of the main frame, forward of the traction chassis. A grader blade sub-assembly, indicated generally at 16, consists generally of a circle mounting bar, indicated generally at 17, which in the illustrated apparatus is a draw bar; a circle structure, indicated generally at 18; and a grader blade and blade mounting, indicated generally at 19**.

The circle draw bar 17 is best seen in FIG. 2 to include a forward beam, indicated generally at 20, and a rearward circle carrying structure, indicated generally at 21, the forward part 22 of which is integral with the rear end of the beam 20. Behind the part 22 of the carrying structure said carrying portion has a section 23 the depth of which is great enough that it forms a housing extending below the circle 18. The housing section 23 receives drive means, indicated generally at 24. The housing section 23 of the circle draw bar merges into a nearly semi-annular upright wall 25 which is part of an internal housing for the circle 18, and integral with the wall 25 is a horizontal top wall 26.

The subassembly 16 is mounted under the main frame 11 by means of a front mounting element and rear mounting elements which engage with cooperating elements carried upon the main frame. At the front end **20*a* of the circle draw bar is a ball 28 which forms part of a ball and socket connection (not shown) by means of which the front of the circle draw bar is connected for universal movement on the front end 11*a* of the main frame. At the back end of the housing section 23 of the rearward circle draw bar portion 21 is a pair of aligned, laterally extending upright plates 29 which are provided with balls 30 that make ball and socket connections with fittings (not shown) on the lower ends of a pair of hydraulic cylinder and piston units 30*a* which are carried upon the main frame 11. Thus, operation of the hydraulic cylinder units 30*a* swings the circle draw bar 17 about the ball and socket connection including the ball 28, which in this respect provides a horizontal pivot axis. A ball 30*b* on one of the webs 29 provides for a ball and socket connection with a side-shift cylinder (not shown) which shifts the draw bar sideways, with the ball 28** providing a vertical pivot axis.

Referring now to FIG. 3, the grader blade and blade mounting 19 includes a grader blade assembly, indicated generally at 31, which is carried upon blade support arms 32 that are integral with the rear portion of the circle structure 18, and there being blade support means consisting of bearing housings 33 which are mounted on transverse pivots 34 on the arms 32. Each of the bearing housings 33 has a forwardly open lower jaw 35 and a forwardly open upper jaw 36 in which a lower blade support rail 37 and an upper blade support rail 38 are respectively mounted for longitudinal sliding movement; and the tilt of the bearing housings 33 about their pivots 34 is controlled by a pair of hydraulic cylinder and piston units, indicated generally at 39.

The arms 32 have forwardly extending lower end portion 40, and the pivots 34 for the bearing housings 33 are nearly at the forward extremities of said arms; and the relationships between the arms 32 and the bearing housings 33 is seen in FIG. 3 to be such that the bearing housings occupy an upright position in which they are very close to the forward faces 41 of the arms 32. This permits the cylinder and piston units 39 to be very compact, and with a very short stroke, so that they are strong and can be substantially protected against damage from dirt and rocks which may pile over the top of the moldboard **31*a* of the blade assembly 31**.

Additional protection of the hydraulic cylinder and piston units 39 is afforded by the fact that they are mounted between the arms 32 in sleeves 42 which are formed integrally with the arms 32 and have their longitudinal axes aligned with portions 44 of the bearing housings 33 which are positioned laterally inwardly from and immediately alongside the arms 32. Each of the hydraulic cylinder and piston units 39 has a cylinder 45 which has a head end 46 and a rod end 47, and a piston with a piston rod 48 which pivotally connects to a transverse pivot pin 49 which is mounted between a pair of webs 50 at the upper, rear end of said bearing housing portion 44.

Each of the sleeves 42 has one side defined by the laterally inward surface of the arm 32, and has the remainder of its perimeter defined by a sleeve wall 51 which is a segment of a cylinder. The sleeve wall 51 and a portion of the arm 32 provide a planar rear end 52 which is provided with a circle of spaced, tapped blind bores 53; and the interior of the sleeve wall 51 is provided with a circumferential shoulder 54. The cylinder and piston unit 39 is mounted for limited universal movement in the sleeve 42 by means of a ball and socket structure, indicated generally at 55. The ball and socket structure includes a spherical bearing 56 which surrounds the cylinder 45 of the unit 39, and a socket assembly 57 in which the spherical bearing 56 is mounted. The socket assembly 57 includes a forward shoulder 58 which abuts the internal forward shoulder 54 on the sleeve wall 51, and a circumferential rear flange 59 which overlies the planar rear end 52 of the sleeve 51 and is secured thereto by a set of machine screws 60 which screw into the threaded bores 53. The socket assembly 57 is, of course, made in two pieces to permit it to be assembled around the spherical bearing 56 before the assembly consisting of the cylinder and piston unit 39 and ball and socket mounting 55 is slid endwise into the sleeve 42 from the rear and secured in place by the machine screws 60.

It is significant, also, that when the piston rod 48 is extended it moves along a shallow chord of a circle struck about the pivots 34, so that working forces transmitted through the pivot pins 49 are applied nearly axially to the piston rods in all positions of the blade assembly support means.

The foregoing detailed description is given for clearness of understanding only and no unnecessary limitations should be understood therefrom as modifications will be obvious to those skilled in the art.

What is claimed is:

1. In a motor grader which has a circle, improved grader blade mounting means comprising, in combination:

a pair of integral, depending support arms at the rear of the circle;

blade carrying means including a pair of bearing housings the lower end portions of which are mounted on transverse pivots in the lower extremities of the support arms, said bearing housings having an upright position forward of said arms and having upper portions which are located laterally inwardly from and immediately adjacent the arms;

jaw means at the front of said blade carrying means adapted to mount a grader blade assembly for lateral shifting movement;

integral sleeves at the upper parts of the arms, said sleeves having one side defined by the arms and having longitudinal axes aligned with extreme upper portions of the bearing housings, extensions of said axes lying substantially tangential to an arc of a circle struck about the transverse pivots which mount the bearing housings;

and a hydraulic cylinder and piston unit supported in each of said sleeves, each of said units having a head end at the rear of the sleeve and a piston rod lying on the projected axis of the sleeve and connected to a transverse pivot on said upper portion of the adjacent bearing housing, whereby working forces are applied substantially axially to said piston rods in all positions of the housings.

2. The combination of claim 1 which includes cooperating means on the head end portion of each cylinder and on the inner surface of each sleeve supporting said unit for limited universal movement.

3. The combination of claim 1 in which each supporting means comprises a spherical bearing embracing the head end portion of the cylinder, and a socket mounted in the sleeve in which said spherical bearing is mounted for limited universal rotary movement.

4. The combination of claim 1 in which the support arms have forwardly extending lower end portions, the transverse pivots for the blade carrying means are close to the forward extremities of said portions, the blade carrying means being in close proximity to the fronts of said arms, and the cylinder and piston units are of a compact, short stroke type.

5. The combination of claim 1 in which the extensions of said axes lie along shallow chords of said circles struck about the transverse pivots which mount the bearing housings.

* * * * *